United States Patent [19]

Hosokawa et al.

[11] Patent Number: 4,641,500

[45] Date of Patent: Feb. 10, 1987

[54] METHOD OF MAKING ICE HAVING A STRIPED PATTERN AND AN APPARATUS FOR MAKING THE SAME

[75] Inventors: Hidehiro Hosokawa, Yokohama; Yoshimichi Iida, Saitama; Hisatsugu Takahashi, Chiba, all of Japan

[73] Assignee: Nichirei Corporation, Tokyo, Japan

[21] Appl. No.: 738,465

[22] Filed: May 28, 1985

[30] Foreign Application Priority Data

May 28, 1984 [JP] Japan ..... 59-106672

[51] Int. Cl.[4] ..... F25C 1/18

[52] U.S. Cl. ..... 62/70; 62/1

[58] Field of Search ..... 62/69, 70, 307, 308, 62/356, 1

[56] References Cited

U.S. PATENT DOCUMENTS

| | | | |
|---|---|---|---|
| 1,185,629 | 6/1916 | Campbell | 62/308 |
| 1,254,511 | 1/1918 | Kleucker | 62/70 |
| 2,133,521 | 10/1938 | Wussow et al. | 62/70 X |
| 3,959,981 | 6/1976 | Anderson | 62/70 X |
| 4,217,762 | 8/1980 | Sakamoto et al. | 62/70 X |

FOREIGN PATENT DOCUMENTS

| | | | |
|---|---|---|---|
| 85/00650 | 2/1985 | PCT Int'l Appl. | 62/308 |

*Primary Examiner*—William E. Wayner

*Attorney, Agent, or Firm*—Wenderoth, Lind & Ponack

[57] ABSTRACT

Square pillar or block ice having a beautiful striped pattern is made by cooling and freezing raw water for ice making in an ice can, the raw water containing at least one soluble material and being subjected alternately to a degree of agitation effective for forming a transparent ice layer and to agitation required for forming a semi-transparent ice layer, thereby forming a striped pattern of the semi-transparent ice layer.

5 Claims, 5 Drawing Figures

METHOD OF MAKING ICE HAVING A STRIPED PATTERN AND AN APPARATUS FOR MAKING THE SAME

BACKGROUND OF THE INVENTION

1. Field of the Invention

This invention relates to a method of making ice with striped patterns and an apparatus of practicing this method and more particularly, it is concerned with a method of making ice with striped patterns from raw water containing soluble materials.

2. Description of the Prior Art

In the ice making technique of the prior art, a drop tube is ordinarily withdrawn from an ice can when $\frac{2}{3}$ of the time required for ice making has passed and a cloudy part thus remains in the core. However, ice has not been known in which a semi-transparent ice and transparent ice are alternately formed in the form of layers to give a striped pattern.

It has also been known to make transparent ice by freezing raw water for ice making with agitation in an ice can.

SUMMARY OF THE INVENTION

It is an object of the present invention to provide a block ice or square pillar ice having a beautiful striped pattern in which a soluble material or component is sealed.

It is another object of the present invention to provide a method of producing ice having a striped pattern from raw water containing a soluble material by controlling air blowing or pressure to change the degree of agitation of the raw water.

It is a further object of the present invention to provide an apparatus for making a block of ice having a beautiful striped pattern in which a soluble material or component is sealed.

These objects can be attained by a method of making ice having a striped pattern comprising cooling and freezing raw water for ice making in an ice can, characterized in that the raw water for ice making contains at least one soluble material and is subjected alternately to stirring or agitation effective for forming a transparent ice layer and to stirring or agitation effective for forming a semi-transparent ice layer, thereby forming a striped pattern of the semi-transparent ice layer, and an apparatus for making ice having a striped pattern, comprising an ice can, an air blowing and stirring means provided with an air pressure regulator for regulating the strength of stirring and an elevating means of the air blowing and stirring means.

BRIEF DESCRIPTION OF THE DRAWINGS

The accompanying drawings are to illustrate the prineiple and merits of the present invention in detail.

DETAILED DESCRIPTION OF THE INVENTION

Figure 1:
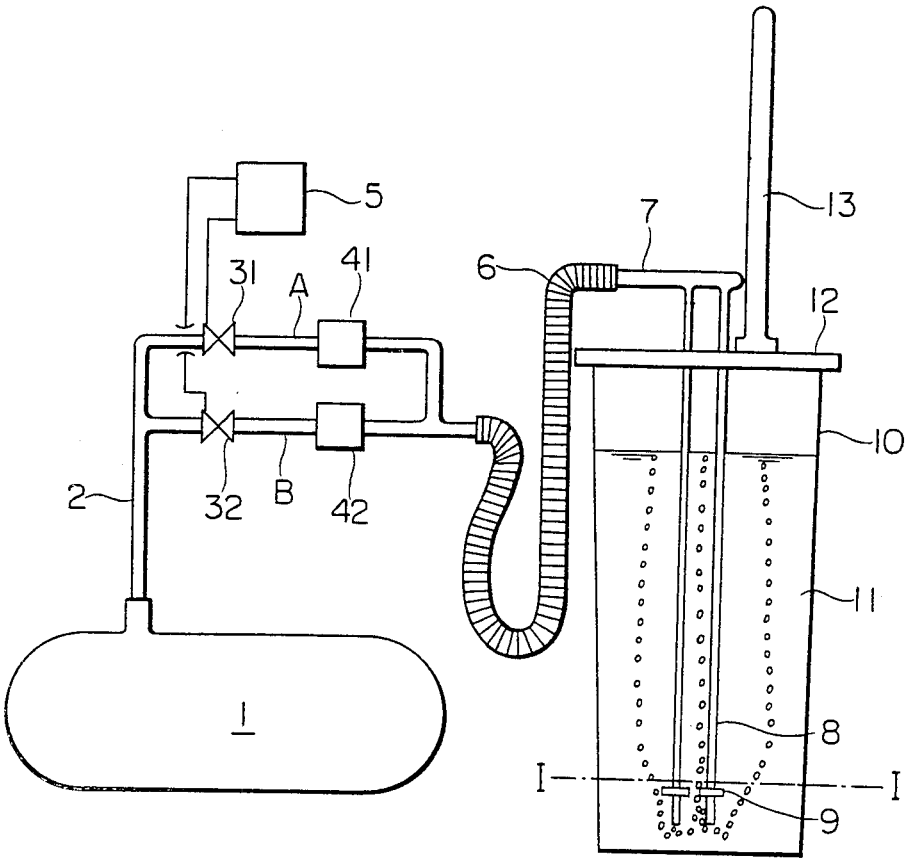
FIG. 1 is a schematic view of one embodiment of the ice making apparatus according to the present invention to show the inside of an ice can.

The inventors have made efforts to make ice containing soluble materials by cooling and freezing raw water containing a large amount of soluble materials with stirring to such an extent as required for forming clear ice in an ice can, but consequently, have found that according to this approach, the soluble materials contained in the raw water are concentrated and separated or segregated from the ice phase to the unfrozen or liquid phase during freezing and thus cannot be sealed in the transparent ice. Accordingly, the inventors have further made studies and experiments. That is, when raw water for ice making, containing large amounts of soluble materials, is frozen with agitation, for example by blowing air bubbles, the air pressure for air blowing is varied to vary the strength of agitation or stirring. According to this experiment, it is found that when the air pressure is increased to strengthen the agitation, a transparent ice layer is formed, but when the air pressure is decreased to lower the strength of the agitation, a semi-transparent ice layer is formed. When the ice making is carried out with varying the air pressure as described above, there is obtained ice having a striped pattern consisting of a semi-transparent ice layer in which the most part or a greater concentration of the soluble materials is contained. The present invention is based on this finding.

Accordingly, the present invention provides a method of making ice having a striped pattern comprising cooling and freezing raw water for ice making in an ice can, characterized in that the raw water for ice making contains a concentration of at least one water-soluble material and is subjected to agitation alternately to such an extent as required for forming a transparent ice layer and to such an extent as required for forming a semi-transparent ice layer, thereby forming a striped pattern of the semi-transparent ice layer.

As the water-soluble materials or components contained in the raw water for ice making, there can be used mineral elements, coloring matters, flavors, salt, sweetening agents, chemical seasonings and mixtures thereof. These soluble materials are dissolved in water in a suitable amount, preferably in a proportion of 0.002 to 0.06 wt %.

In addition, the present invention provides an apparatus for making ice having a striped pattern, comprising an ice can, an air blowing and agitating means provided with an air pressure regulator for regulating the strength of the agitation and an elevating means of the air blowing and agitating means.

In this apparatus, there are preferably provided an air pipe having an electromagnetic valve and a pressure control valve for an air pressure sufficient enough to impart agitation required for forming a transparent ice layer and another air pipe having an electromagnetic valve and a pressure control valve for an air pressure sufficient enough to impart agitation required for forming a semi-transparent ice layer, in parallel, between a compressed air reservoir and the air blowing and agitating means, and a controlling device for opening and closing alternately the electromagnetic valves in the air pipe and the other air pipe, thereby controlling the strength of the agitation by air blowing.

Preferred embodiments of the present invention will now be explained in detail with reference to the accompanying drawings.

Figure 4:
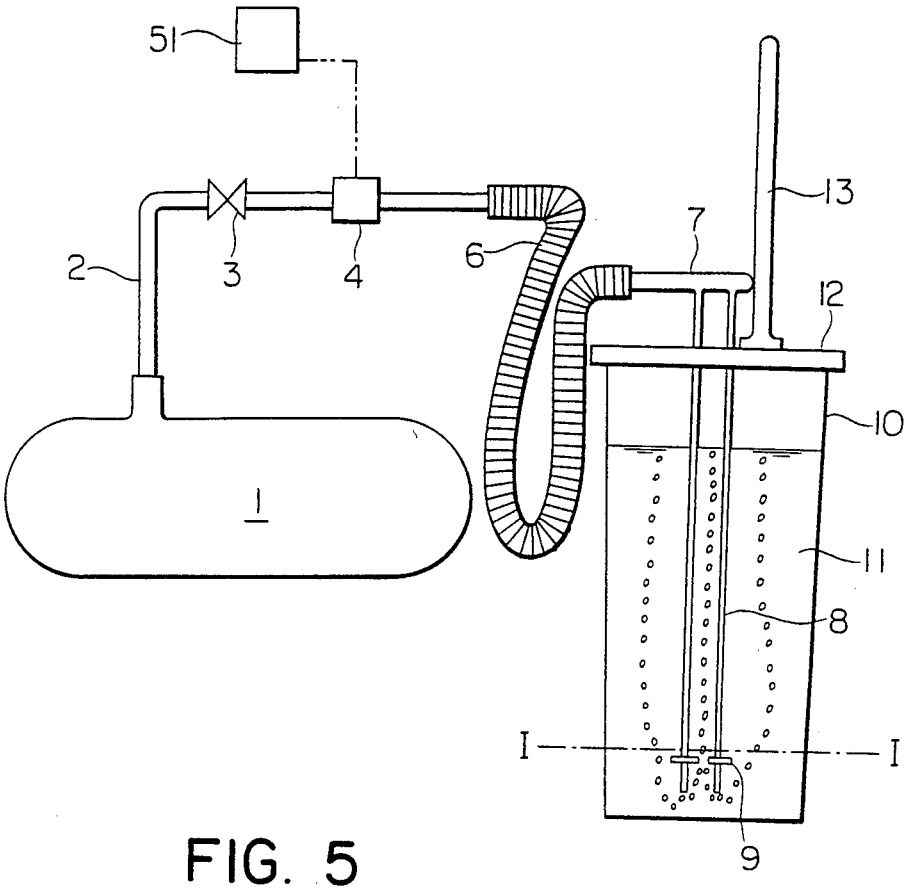
FIG. 4 is a schematic view of another embodiment of the ice making apparatus according to the present invention to show the inside of an ice can.

Production of ice having a striped pattern according to the present invention is carried out using apparatus for ice making, for example, as shown in FIG. 1 and FIG. 4. Referring to FIG. 1, one embodiment of the apparatus for ice making according to the present invention comprises compressed air reservoir 1, air feed pipe 2, electromagnetic valve 31 in air pipe A, pressure control valve 41 for controlling the pressure of air in air pipe A so that air pipe A is fed with air in an amount sufficient to impart to raw water 11 for ice making agitation required for forming a transparent ice layer during freezing, electromagnetic valve 32 in air pipe B, pressure control valve 42 for controlling the pressure of air in air pipe B so that air pipe B is fed with air in an amount sufficient to impart to raw water 11 for ice making agitation required for forming a semi-transparent ice layer during freezing, control system 5 for alternately opening and closing electromagnetic valves 31 and 32 at a predetermined interval of time, flexible air feed tube 6, air feed pipe 7, drop tube 8 for feeding air to agitate raw water 11 for ice making, air rectifying vanes 9 for imparting a sufficient water agitation or dispersion to the air fed in raw water 11 for ice making, ice can 10, cover 12 and lift 13 fitted to cover 12 for lifting drop tube 8 when freezing proceeds.

Figure 2:
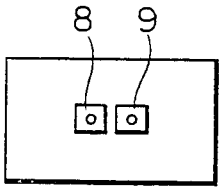
FIG. 2 is a cross-sectional view along line I—I in FIG. 1 and FIG. 4.

FIG. 2 is a cross-sectional view of ice can 10 along line I—I in FIG. 1 and FIG. 4, showing that two drop tubes 8 provided with air rectifying vanes 9 are positioned substantially in the center of ice can 10.

One embodiment of the method of making ice with a striped pattern using this ice making apparatus according to the present invention will be illustrated.

Raw water 11 containing large amounts of soluble materials is charged in ice can 10, covered with cover 12 provided with lift 13 and drop tube 8 connected with compressed air reservoir 1, as shown in FIG. 1 and drop tube 8 is then lowered. This ice can is set into a cooling brine for ice making and ice making is started. Simultaneously with the start of ice making, control system 5 is operated to open electromagnetic valve 31 and air, whose pressure is adjusted to 0.3 kg/cm$^2$G (gauge) by pressure control valve 41, is supplied to ice can 10 from compressed air reservoir 1 via air feed pipe 2, air pipe A, flexible air feed tube 6, air feed pipe 7 and drop tube 8. The air introduced into the bottom of ice can 10 is uniformly dispersed by air rectifying vanes 9 and allowed to rise in ice can 10 to thus agitate sufficiently raw water 11, after which transparent ice is frozen from the part in contact with ice can 10. When the transparent ice layer grows in a suitable thickness on the wall surface and bottom surface of ice can 10, control system 5 is operable to close electromagnetic valve 31 and to open electromagnetic valve 32, and air, whose pressure is adjusted to 0.15 kg/cm$^2$G by pressure control valve 42, is supplied to ice can 10 via air pipe B and drop tube 8. The air introduced into the bottom of ice can 10 is uniformly dispersed by air rectifying vanes 9 and allowed to rise in ice can 10, as described above, to thus suitably agitate raw water 11. A semi-transparent ice layer is newly formed by the water agitation using the air under such a pressure and large amounts of soluble materials contained in raw water 11 are sealed or frozen in this ice layer. The semi-transparent ice layer is formed on the above described transparent ice layer and grown to increase its thickness with the continuation of ice making.

When the semi-transparent ice layer grows in a suitable thickness, control system 5 is operated to close electromagnetic valve 32 and to open electromagnetic valve 31, and air, whose pressure is adjusted to 0.3 kg/cm$^2$G by pressure control valve 41, is supplied to ice can 10 via air pipe A and drop tube 8. The air introduced therein is uniformly dispersed by air rectifying vanes 9 and allowed to rise in ice can 10, as described above, to thus agitate raw water 11. By this agitation, a transparent ice layer is further formed on the above described semi-transparent ice layer and grown to increase its thickness with continuation of ice making. When the transparent ice layer is grown to a suitable thickness, control system 5 is operated to close electromagnetic valve 31 and to open electromagnetic valve 32 and a semi-transparent ice layer is further formed on the transparent ice layer in an analogous manner to that described above.

When the alternate opening and closing of electromagnetic valves 31 and 32 are continued as described above, transparent ice layers and semi-transparent ice layers are alternately formed in ice can 10 to give a striped pattern of the semi-transparent ice layers. Since the part of liquid raw water 11 for ice making in ice can 10 becomes narrower with the growth of these ice layers, lift 13 is operated at a suitable time to lift drop tube 8 and the ice making is further continued to freeze the remaining raw water. The ice making is thus completed.

Figure 3:
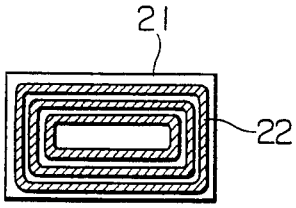
FIG. 3 is a cross-sectional view of ice having a striped pattern made according to the present invention, along line II—II in FIG. 5.
Figure 5:
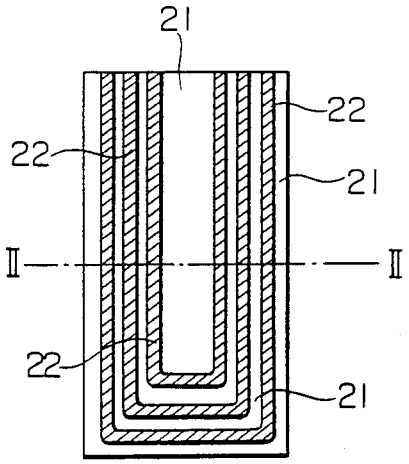
FIG. 5 is a vertical-sectional view of ice having a striped pattern made according to the present invention.

According to these procedures, transparent ice layers 21 and semi-transparent ice layers 22 are alternately formed as shown in FIG. 3 and FIG. 5, thus obtaining block or square pillar ice with striped pattern 22. FIG. 5 is a vertical sectional view of the block ice with a striped pattern made by the ice making apparatus of the present invention and FIG. 3 is a cross-sectional view along line II—II in FIG. 5.

Referring to FIG. 4, another embodiment of the apparatus for ice making according to the present invention comprises compressed air reservoir 1, air feed pipe 2, valve 3, pressure control valve 4, control system 51 for controlling the pressure of air by pressure control valve 4, flexible air feed tube 6, air feed pipe 7, drop tube 8, air rectifying vanes 9, ice can 10, raw water 11 for making ice in ice can 10, and cover 12 provided with drop tube 8 and lift 13 for moving the drop tube 8 upwards and downwards. In the operation of this apparatus, pressure control valve 4 is controlled by control system 51 so that the air fed from drop tube 8 to ice can 10 may alternately have a pressure sufficient to impart agitation required for forming a transparent ice layer and a pressure sufficient to impart agitation required for forming a semi-transparent ice layer. Change of these pressures is intermittenly carried out to alternately form transparent ice layers and semi-transparent ice layers, thus obtaining a striped pattern.

Another embodiment of the method of making ice with a striped pattern using this ice making apparatus according to the present invention will be illustrated.

Raw water 11 for ice making, containing large amounts of soluble materials, is charged in ice can 10, covered with cover 12 provided with lift 13 and drop tube 8 connected with compressed air reservoir 1, as shown in FIG. 4, and drop tube 8 is then lowered. This ice can is set into a cooling brine for ice making and ice making is started. Simultaneously with the start of ice making, control system 51 is operated to control pressure control valve 4 so that air under a pressure of 0.3 kg/cm$^2$G is passed therethrough and valve 3 is opened to feed air under a pressure of 0.3 kg/cm$^2$G to ice can 10 from compressed air reservoir 1 via flexible air feed tube 6, air feed pipe 7 and drop tube 8. The air introduced into ice can 10 is uniformly dispersed by air rectifying vanes 9 and allowed to go up in ice can 10 to thus agitate sufficiently raw water 11, after which transparent ice is frozen from the part in contact with ice can 10.

When the transparent ice layer grows in a suitable thickness on the wall surface and bottom surface of ice can 10, control system 51 is operated to control pressure control valve 4 so that air under a pressure of 0.15 kg/cm$^2$G is passed therethrough and air under a pressure of 0.15 kg/cm$^2$G is fed to ice can 10 through drop tube 8. The air introduced into ice can 10 is uniformly dispersed by air rectifying vanes 9 and allowed to rise in ice can 10, as described above, to thus agitate suitably raw water 11. A semi-transparent ice layer is newly formed on the transparent ice layer by the water agitation using the air under such a pressure and the large amounts of soluble materials contained in raw water 11 are sealed or frozen in the resulting ice layer. The semi-transparent ice layer grows with the continuation of ice making.

When the semi-transparent ice layer grows to a suitable thickness, control system 51 is operated to control pressure control valve 4 so that air under a pressure of 0.3 kg/cm$^2$G is passed therethrough, thus forming a transparent ice layer. By repeating the control of control valve 4 by operating control system 51 as described above, transparent ice layers and semi-transparent ice layers are alternately formed in ice can 10 to obtain a striped pattern of the semi-transparent ice layers. Since the part of liquid raw water 11 for ice making in ice can 10 becomes narrower with the growth of these ice layers, lift 13 is operated at a suitable time to lift drop tube 8 and the ice making is further continued to freeze the remaining raw water. The ice making is thus completed.

According to these procedures, transparent ice layers 21 and semi-transparent ice layers 22 are alternately formed as shown in FIG. 3 and FIG. 5, thus obtaining a block or square pillar of ice with a striped pattern of the semi-transparent ice layers 22.

In the production of ice having a striped pattern according to the present invention, the soluble materials or components to be added to raw water for ice making can be chosen from any materials which can be used for food, for example, mineral elements, coloring matters, flavors, salt, sweetening agents, chemical seasonings and mixtures thereof. Examples of the mineral elements are calcium hydroxide and sodium phosphates. Examples of the coloring matters are FD & C, Red No. 40 (CINo. 16035) for food and FD & C, Yellow No. 5 (CINo. 15985) for food. Examples of the sweetening agents are cane sugar, grape sugar, fruit sugar, maltitol and aspartame. Examples of the chemical seasonings are sodium glutamate and 5'-nucleotide.

The agitation of raw water for ice making in an ice can is preferably carried out by blowing compressed air therein and the degree or strength of agitation can be controlled by controlling the pressure of air to be blown. Generally, air is blown under a pressure of at least 0.3 kg/cm$^2$G, preferably 0.3 to 0.35 kg/cm$^2$G in the case of forming a transparent ice layer and under a pressure of at most 0.15 kg/cm$^2$G, preferably 0.1 to 0.15 kg/cm$^2$G in the case of forming a semi-transparent ice layer. These pressures can be applied when a drop tube is dipped with a depth of approximately 80 cm. In the latter case, the agitation such as by air blowing can be omitted as occasion demands. Change of the pressure is preferably carried out every 30 to 60 minutes.

The following examples are given in order to illustrate the present invention in greater detail without limiting the same.

Example 1

6 g of calcium hydroxide was dissolved in 135 liters of water to prepare raw water for ice making. The 135 liters of raw water was charged in ice can 10, which was then dipped in a brine cooled at −7° C. and covered with cover 12 provided with drop tube 8 and lift 13 as shown in FIG. 1, and the drop tube 8 was lowered in the ice can. This drop tube 8 was connected with an air feed mechanism as shown in FIG. 1, comprising air pipe A having pressure control valve 41 controlled so as to impart a pressure of 0.3 kg/cm$^2$G and electromagnetic valve 31, air pipe B having pressure control valve 42 controlled so as to impart a pressure of 0.15 kg/cm$^2$G and electromagnetic valve 32, and control system 5 controlled so as to open and close alternately electromagnetic valve 31 and electromagnetic valve 32 at an interval of 30 minutes. Ice making was thus started. During ice making, air at a pressure of 0.3 kg/cm$^2$G and air at a pressure of 0.15 kg/cm$^2$G were introduced into ice can 10 via drop tube 8 to form alternately transparent ice layers and semi-transparent ice layers. With the growth of these ice layers, drop tube 8 was gradually lifted and the ice making was continued. After 48 hours, the raw water in ice can 10 was completely frozen, thus obtaining block ice having 48 stripes in which the mineral component was sealed.

The thus resulting block ice, having a beautiful appearance, was suitable for use as the so-called block of ice or in preparation of beverages, e.g. whisky on the rocks.

Examples 2

2.8 g of Food Color, Green BW and 75 ml of Food Flavor, Champagne Cider Essence were dissolved in 135 liters of water to prepare raw water for ice making. (Green BW and Champagne Cider Essence are commercial names of Sanei Kagaku Kogyo K.K.) This raw water was processed in an analogous manner to Example 1, thus obtaining a block of ice having 48 stripes in which the food color and flavor were sealed.

The thus resulting block ice, having a beautiful appearance, was suitable for use as the so-called block of ice and in preparation of beverages, e.g. whisky on the rocks.

What is claimed is:

1. A method of making ice having a striped pattern which comprises the step of cooling and freezing raw water containing at least one soluble material, said cooling and freezing of the raw water being performed while simultaneously agitating the raw water during all or part of the cooling and freezing step, said agitating of the raw water being alternately repeated in two steps, the first step being with agitating the raw water with a degree of agitation effective to form a transparent ice layer and the second step being without agitating or with agitating the raw water with a degree of agitation effective to form a semi-transparent ice layer.

2. The method of claim 1, wherein the soluble components are mineral components, coloring matters, flavors, salt, sweetening agents, chemical seasonings and mixtures thereof.

3. The method of claim 1, wherein the agitation of the raw water is carried out by blowing air therein.

4. The method of claim 3, wherein the air is blown at a pressure of at least 0.3 kg/cm$^2$G to form a transparent ice layer and at a pressure of at most 0.15 kg/cm$^2$G to form a semi-transparent ice layer.

5. The method of claim 4, wherein the semi-transparent ice layer is formed without agitation.

* * * * *